United States Patent [19]

Mangin et al.

[11] Patent Number: 5,054,825

[45] Date of Patent: Oct. 8, 1991

[54] ANTIPANIC LOCK AND HOUSING FOR SUCH A LOCK

[75] Inventors: Robert Mangin, St. Benoit sur Seine; Jean-Pierre Muller, Cormost; Francois Weil, Romilly sur Seine, all of France

[73] Assignee: Vachette, France

[21] Appl. No.: 539,811

[22] Filed: Jun. 18, 1990

[30] Foreign Application Priority Data

Jun. 20, 1989 [FR] France ..... 8908179

[51] Int. Cl.[5] ..... E05B 65/10; E05B 15/04

[52] U.S. Cl. ..... 292/92; 292/244; 292/336.3

[58] Field of Search ..... 292/226, 244, 92, 21, 292/336.3

[56] References Cited

U.S. PATENT DOCUMENTS

| | | | |
|---|---|---|---|
| 231,171 | 8/1880 | Jennings | 292/244 |
| 917,685 | 4/1909 | Voight | 292/92 |
| 927,654 | 7/1909 | Hood | 292/92 |
| 1,014,960 | 1/1912 | Ericson | 292/21 |
| 2,858,157 | 10/1958 | Eichacker | 292/244 |
| 2,991,107 | 7/1961 | Eichacker et al. | 292/336.3 |
| 3,897,092 | 7/1975 | Atkins | 292/92 |
| 4,988,136 | 1/1991 | Gressett, Jr. | 292/244 |

FOREIGN PATENT DOCUMENTS

| | | | |
|---|---|---|---|
| 580503 | 9/1946 | United Kingdom | 292/92 |

*Primary Examiner*—Gary L. Smith
*Assistant Examiner*—Darnell M. Boucher
*Attorney, Agent, or Firm*—Cushman, Darby & Cushman

[57] ABSTRACT

The antipanic lock comprises at least a bolt and an actuating rod pivotingly connected to a door by a unit formed by at least two housings fixed onto the door and two levers (2) integral, towards their one end, with the actuating rod and pivotingly mounted, at their other end, into an associated housing (4); said lock comprises a torsion spring (10), in a first dihedron corresponding to a first direction of opening of the door, the actuating rod and the levers (2) towards a neutral position, one of the levers being a control lever co-operating with members in order to actuate the bolt. The first leg of a torsion spring (10) is arranged so as to allow the associated lever (2) to pivot in order to be located in a second dihedron corresponding to a second direction of opening of the door; a second leg of a torsion spring (10) is provided to pull off towards a neutral position, in this second dihedron, an associated lever (2) and the actuating rod, while the bolt control-lever and the members (26) of its housing are arranged so as to further ensure the actuation of the bolt when this control lever had been located in the second dihedron, the lock thus being reversible.

14 Claims, 2 Drawing Sheets

ANTIPANIC LOCK AND HOUSING FOR SUCH A LOCK

The invention relates to an antipanic safety-lock of the type of those fitted onto the doors intended to be quickly opened from inside by simple actuation by an operator of a rod controlling the movement of the bolt of said lock in the keeper it is associated with. Such safety-locks are viz. often used on emergency-exit doors of public premises and other facilities (cinemas, theatres, restaurants, etc . . . ).

Until now, most antipanic lock models of this kind had to be made in two versions, one intended to be adapted onto doors called "right-hand" doors opening with a pushing motion clockwise with respect to the floor, the other one intended to be adapted onto doors called "left-hand" doors opening with a counterclockwise push. Therefore, in order to meet the users' demands, it was necessary to keep in stock, for each lock model, both versions of same, which resulted in important extra storage costs and frequent sources of errors generating losses of time.

In order to cope with this disadvantage, it has already been proposed to use antipanic locks which can be adapted onto both types of doors. However, such locks have a complex handling, their reversibility requiring the use of a specific tooling. Furthermore, such locks have a relatively high cost price.

As far as this invention is concerned, it provides an antipanic lock device which can be adapted both onto "right-hand" or "left-hand" doors, which allows, viz., to substantially reduce the necessary stocks and the errors, this device offering economical advantages and being very easy to be handled, its reversibility being possible without specific tooling. In particular, this invention provides an antipanic lock in which the bolt-actuating mechanism of said lock can be reversed so that the actuating rod controlling said bolt is capable of acting in same in both directions of its pivoting motion.

Thus, the object of this invention is an antipanic lock intended to be fitted onto a door and comprising at least a bolt allowing two positions, one enabling the opening of the doors, the other one being a closing position in which said bolt can be engaged into a keeper, this lock comprising, furthermore, an actuating rod pivotingly connected to said door by means of a unit formed by at least two housings fixed onto said door and two levers integral, towards their one end, with the actuating rod and pivotingly mounted, at their other end, into an associated housing, said lock comprising a first leg of a torsion spring, in a first dihedron corresponding to a first direction of opening of the door, the actuating rod and the levers towards a neutral position, one of the levers being a central lever co-operating with members in order to actuate the bolt during the angular movement, in this first dihedron, of the actuating rod, this lock being characterized in that the first leg of the torsion spring is arranged so as to allow the associated lever to pivot in order to be located in a second dihedron corresponding to a second direction of opening of the door, that a second second leg of the torsion spring is provided to pull off towards a neutral position, in this second dihedron, an associated lever and the actuating rod, whilst the bolt control-lever and the members of its housing are arranged so as to further ensure the actuation of the bolt when this lever has been located in the second dihedron, the lock thus being reversible.

Advantageously, the first and second legs of the torsion spring are each comprised as a two-leg spring swivelled in the housing, about the pivoting shaft of the lever of this housing, one leg of this spring resting against a projecting part of said lever, the other leg of this spring resting against an organ integral with said housing.

Generally, at least one housing of the lock comprises a first thrust member limiting the stroke of the associated lever in the first dihedron, this lever coming to rest against said thrust for the neutral position; according to the invention, the first thrust member may be moved within its housing, in order to release the angular movement of the associated lever, the lever being then capable of pivoting in order to be located in the second dihedron, and at least one housing comprises a second thrust member allowing to limit the angular movement of the actuating rod in this second dihedron, one lever coming to rest against this second thrust member for the neutral position in the second dihedron.

Preferably, one housing comprises a thrust member which simultaneously serves as both first and second thrust. The or each thrust member can co-operate with retaining means capable of stabilizing same in a position in which it limits the stroke of a lever.

The invention also relates to a housing for an antipanic lock such as defined hereinabove.

According to a first embodiment, such a housing is characterized in that it comprises a bottom onto which is arranged the member forming the thrust member, said member being capable of translatingly moving on said bottom.

The member forming a thrust member may comprise two protuberances separated from each other by a recess in which the end of the associated lever can pivot, when the member forming a thrust member is aparted from its operating position, each protuberance acting as a very thrust member according to the direction of opening of the door to be fitted. Said member forming a thrust can be maintained on said bottom by means of a rod acting as a thrust guide, passing through the housing at the level of the bottom of the recess of said member.

According to a second embodiment, the housing comprises a bottom and the member forming a thrust member can be located, on the bottom of the housing, in two positions symmetrical to each other with respect to the plane orthogonal to the bottom and passing through the geometrical pivoting axis of the associated lever. Preferably, the member forming a thrust member can pivot in the housing about a shaft orthogonal to the geometrical pivoting axis of the associated lever and located in the plane passing through this geometrical axis and perpendicular to the bottom of the housing. Advantageously, the member forming a thrust member is associated with an opening having the shape of an arc of a circle on the bottom of its housing, this opening co-operating with a retaining screw.

Generally, the housing containing the member forming a thrust member is different from the housing comprising the bolt. However, in one and the same housing, the member forming a thrust member could be combined with the bolt and its mechanism.

The housing comprising the bolt and the control lever, according to the invention, is characterized in that the bolt is a side bolt pivoting in the housing, this bolt being tilted by an actuating pawl co-operating with two parts of the bolt symmetrically distributed with respect to the plane perpendicular to the bottom of the housing and passing through the axis of rotation of the lever.

The invention consists, besides the arrangements set forth hereinabove, in a number of further positions which will be more explicitly explained below with respect to embodiments described with reference to the drawings which are given only as illustrating examples and are not exhaustive.

Figure 7:
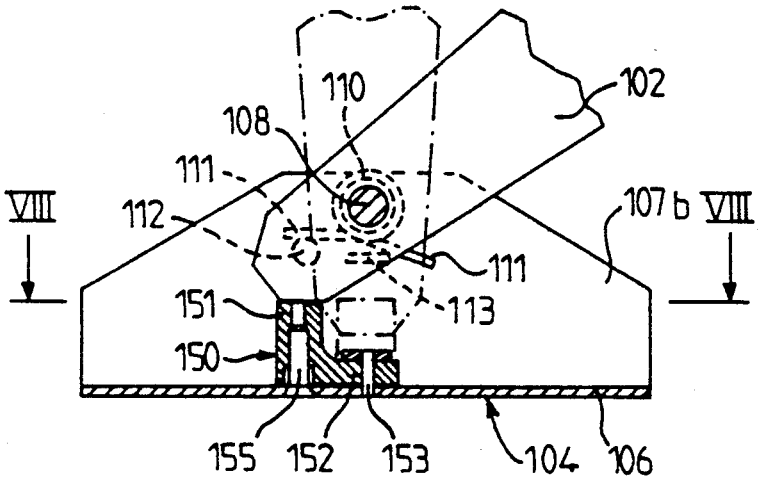
FIG. 7 is a cross-sectional view of a detail of an antipanic lock according to a second embodiment, this lock having been shown chain-dotted and in continuous lines in two positions.
Figure 8:
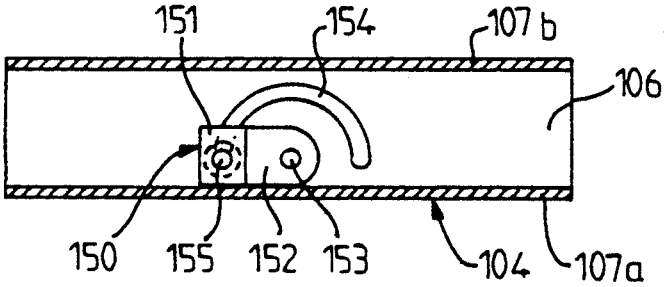

FIG. 8, finally, is a view according to line VIII—VIII of FIG. 7.

In FIGS. 1 to 6, it is seen that an antipanic lock according to a first embodiment comprises an actuating rod 1 connected, at its ends, by levers Z and 3 to housings bearing the reference numbers 4 and 5, respectively, and intended to be fixed onto a door.

Each housing 4 or 5 has a straight U-shaped section defined by a rectangular bottom and two side walls 7*a*, 7*b* parallel to the length of said bottom 6 and having a shape of a rectangle topped by a trapezium. Each lever 2 or 3 is fitted in its housing 4 or 5 on a pivoting rod 8 supported by the walls 7*a*, 7*b* of said housing, this rod 8 extending between the trapezoidal parts of said walls 7*a*, 7*b*, perpendicularly to same, substantially at the level of the median length of the housing 4 or 5, this rod 8 passing through the lever 2 or 3, which it is associated with, towards its end farthest away from the actuating rod 1. The levers 2 or 3 are flat blades, parallel to the walls 7*a*, 7*b*, having a rectangular shape the width of which substantially increases when moving away from the housings 4 or 5 towards the actuating rod 1. The end of these levers 2 or 3 farthest away from said actuating rod 1 has a substantially rounded trapezoidal shape. These levers 2 or 3 comprise, at their ends connected to the actuating rod 1, sleeves 9 into which said actuating rod 1 is engaged. The levers 2 or 3 are each arranged close to the wall 7*a* of their housing, in front of the other housing.

Onto the part of the rod 8 of the lever 2 arranged between the lever 2 and the wall 7*b*, is swivelled a spring 10 ending with two legs 11 having substantially the same length and tangent to said rod 8, substantially at the level of the part of said rod 8 which is in front of the bottom 6 of the housing 4. The actuating lever 2 comprises, at its end farthest away from the actuating rod 1, on the side opposite to said rod 1 with respect to the rod 8, a cylindrical thrust 12, or pawl, projecting with respect to the lever 2, perpendicularly to same, one leg 11 of said spring 10 coming to rest against said thrust 12, tangentially to same, in the part of said thrust 12 which is diametrically opposite to its part in front of the bottom 6. The housing 4 comprises, furthermore, a foot 13 having an elongated rectangular shape extending in projection with respect to the wall 7*b*, perpendicularly to said wall, and parallelly to the bottom 6. This foot 13 is centered substantially on the plane perpendicular to the bottom 6 passing through the axis of the rod 8. The leg 11 of the spring 10 which is farthest away from the thrust 12 rests against one edge of this foot 13. The distance between the axis of the rod 8 and the median plane of this foot 13 substantially corresponds to half the distance between the axis of the rod 8 and the axis of the cylindrical thrust 12, the width of this foot 13 substantially corresponding to the diameter of the rod 8.

The bottom 6 is associated with a thrust member 14 capable of sliding on said bottom and comprising a symmetry plane perpendicular to the axis of said bottom. This thrust member 14 has a U-shape, the legs of which are formed by two protuberances 15*a*, 15*b* separated from each other by a recess 16 and the bottom of which is parallel to the bottom 6. The height of the protuberances 15*a*, 15*b* with respect to the bottom 6 substantially corresponds to the width of the rectangles partly defining the periphery of the walls 7*a*, 7*b*. This thrust member 14 is associated with a cylindrical guiding rod 17 having a diameter substantially identical to the diameter of the pawl 12, this rod 17 extending between the two walls 7*a*, 7*b* of the housing 4, perpendicularly to same and right above the bottom of the recess 16. The thrust member 14 is, furthermore, symmetrically subjected to the action of two springs 18 acting oppositely, viz. in compression, arranged in the recesses 19 of said thrust member 14. These recesses 19 extend right above the bottom 6. Each spring 18 rests, at its one end, against a wall of the recess 19 which it is associated with and, at its other end, against a projection 20 of the bottom 6, these two springs exerting on the member 14 opposite efforts parallelly to the bottom 6, along the length of same. Finally, each protuberance 15*a*, 15*b* is extended, on the side farthest away from the recess 16, by two organs 21 substantially parallel to the plane of the walls 7*a*, 7*b*.

The lever 3 comprises, at its end farthest away from the actuating rod 1, a cylindrical actuating pawl 22 (see FIGS. 5 and 6) projecting with respect to said lever 3, on the side of the wall 7*b*, the diameter of this pawl 22 substantially corresponding to the diameter of the pawl-thrust 12, its length substantially corresponding to half the length of the housing 5. The housing 5 is associated with a bolt 23 passing through the wall 7*b* farthest away from the housing 4. This bolt 23 is pivotingly fitted on a rod 24 supported by the two walls of a clamp (not shown) arranged on the wall 7*b* and perpendicular to the bottom 6 and to said wall 7*b*, said rod 24 being perpendicular to said clamp.

The bolt 23 has an outer surface generated by generating lines parallel to the length of the bottom 6 of the housing 5 resting against a straight section having a shape of substantially a quarter circle, the centre of which is situated on the axis of the rod 24, the arched area of this bolt 23 being arranged partly inside the housing 5 and partly outside said housing 5. The edge of the bolt 23, which is arranged inside the housing 5, is extended by a set-back 23*a* coming to rest against the wall 7*b* during the pivoting of said bolt 23. The edge of the bolt 23, which is opposite to its arched area, is extended, perpendicularly to the wall of the bolt 23, which is inside the housing 5, on both sides by journals 25 comprising, on their face in front of the bottom 6, two notches 26. The journals 25 and the notches 26 are symmetrical with respect to the median plane of the bolt 23, orthogonal to the rod 24. The notches 26 are intended to co-operate with the actuating pawl 22, said notches 26 having substantially a shape complementary to the pawl 22 and being located on the circular path same describes during a motion of the lever 3. A part 27, which connects these two notches 26, has a curved shape allowing the angular spring-movement of the pawl 22.

The actuating rod 1 and the levers 2 and 3 are arranged, with respect to the half-space defined by the plane parallel to the bottoms 6 passing through the axes 8, in one of the two right dihedrons of this half-space defined by the plane perpendicular to the bottom 6 passing through the axes 8. If no actuation is made onto the thrust member 14, the angular spring-movement of the levers 2 and 3 and the actuating rod 1 with respect to the axis 8 is limited, in this first dihedron, between, on the one hand, a position in which the levers 2 and 3 are substantially parallel to the bottom 6 and in which the actuating pawl 22 causes the bolt 23 to tilt into its opening position and, on the other hand, a position in which the lever 2 rests, with one side of its trapezoidal end, against a protuberance 15*a* or 15*b* of the thrust 14, the bolt being in closing position, i.e. partly out of the housing 5.

In FIGS. 7 and 8 is shown an antipanic lock according to a second embodiment of the invention. As far as the members of this second embodiment which are unchanged with respect to the members of the first embodiment are concerned, the same reference numbers, increased by 100, have been maintained.

This antipanic lock comprises an actuating rod integral, at its ends, with levers pivotingly mounted in housings, the FIGS. 7 and 8 showing the housing 104 associated with the lever 102, the other lever-housing unit being unchanged. The pivoting axis of the lever 102 in the housing 104 is a rod 108 mounted on the walls 107*a*, 107*b* of the housing 104 and parallel to the bottom 106 of said housing. On said spindle 108 is swivelled a spring 110 the two legs 111 of which respectively rest, one against a thrust 112 the end of the lever 102 opposite to the actuating rod is provided with, the other one against a foot 113 integral with one of the walls 107*a* or 107*b*.

The bottom 106 of said housing 104 is associated with a member 150 forming a thrust having a straight section in the shape of an bent one leg 151 of which is the very thrust perpendicular to the bottom 106. This leg 151 extends from said bottom 106 on a height substantially corresponding to the width of the rectangles defining partly the periphery of the walls 107*a*, 107*b*, the other leg of this member 150 being a foot 152 of reduced thickness, parallel to said bottom 106 and pivotingly mounted on a shaft 153 perpendicular to the bottom 106 and arranged in the plane perpendicular to the bottom 106 passing through the axis of the rod 108. This spindle 153 is close to the wall 107*a* of the housing 104.

The distance between the spindle 153 and the thrust 151 is slightly larger than the thickness of the lever 102. The length of the unit formed by the foot 152 and the thrust 151 is slightly smaller than the inner width of the bottom 106, which enables the pivoting of the unit in the housing 104, substantially according to half a circle. The bottom 106 is, furthermore, passed through by an opening 154 in the shape of an arc of a circle centred about the spindle 153, symmetrically arranged on both sides of the plane perpendicular to the bottom 106 and passing through the axis of the rod 108, the radius of the arc of a circle of this opening 154 substantially corresponding to the distance between the spindle 153 and the axis of the thrust 151. The thrust 151 is itself passed through, in its axial height, by a tapped cylindrical recess cooperating with a screw 155 passing through the opening 154, the head of this screw 155 being arranged opposite to the member 150 with respect to the bottom 106.

In operating position, the foot 152 and the thrust 151 are arranged alongside the wall 107*a*, the thrust member 150 being kept in position by the clamping of the bottom 106 between the thrust 151 and the head of the screw 155. The angular spring-movement of the levers and the actuating rod is limited to a first dihedron by the thrust 151, in the same way as in the example of the first embodiment.

Such antipanic locks are used in the way which will be described now. If the lock is adapted to the direction of opening of the door, i.e. if the levers and the actuating rod are located in the right dihedron with respect to the housings, it is fitted onto this door by arranging the housing in which is fitted the bolt of the lock on the side opposite to the hinge of the door, whereby the housings of the lock may be, e.g., screwed onto this door. If, by contrast, the actuating rod and the actuating levers are arranged in the wrong dihedron and, consequently, do not allow to directly fit the antipanic lock onto the door, one will proceed to the reversing of the unit of actuating levers and rod.

Figure 1:
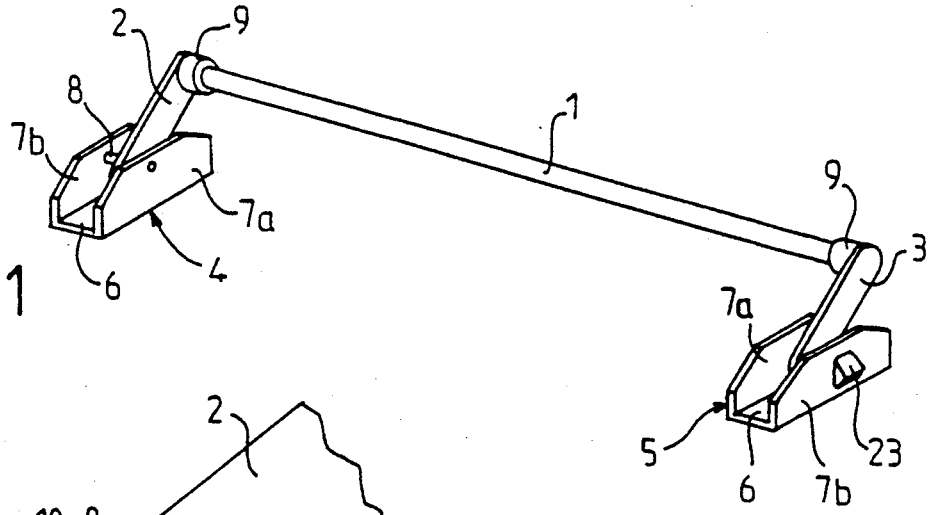
FIG. 1 is perspective view of an antipanic lock according to a first embodiment of the invention.
Figure 2:
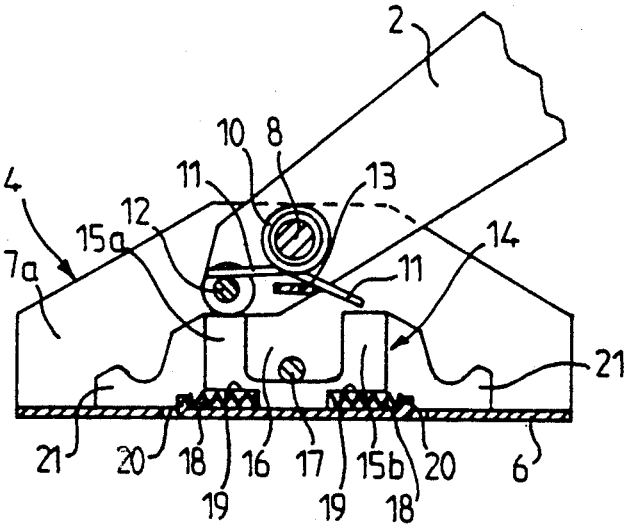
FIG. 2 is an inverted cross-sectional view of a housing of the lock shown in FIG. 1, said lock being shown in both figures in a first neutral position.
Figure 3:
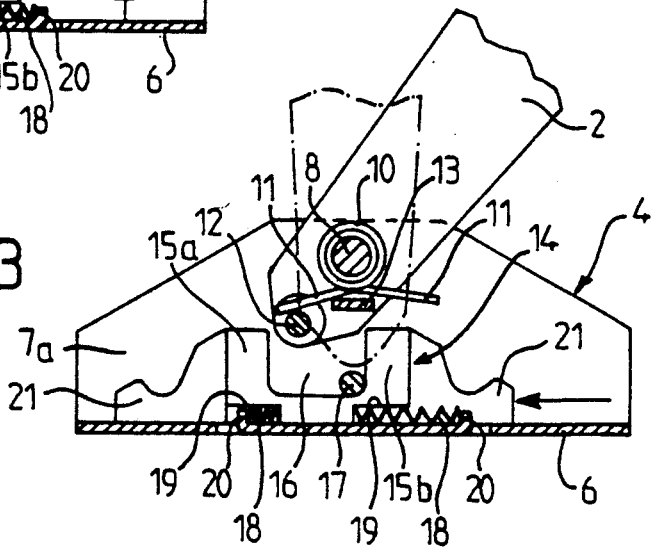
FIG. 3 is a cross-sectional view, similar to FIG. 2, of the housing and the associated lever during reversing.
Figure 4:
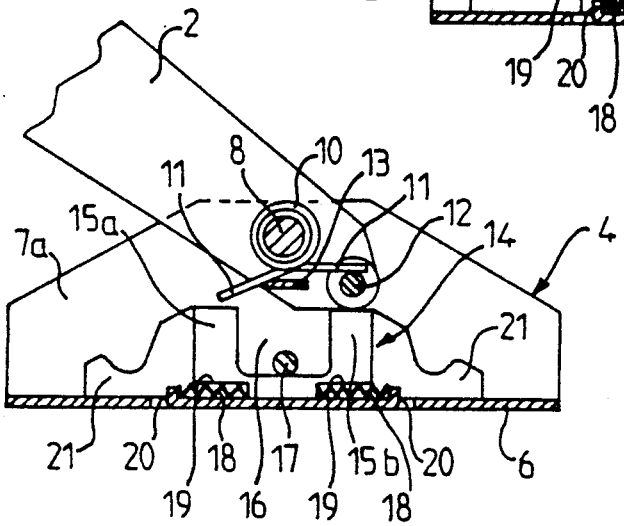
FIG. 4 is a cross-sectional view, similar to FIG. 2, said lock being shown in this figure in a second neutral position.
Figure 5:
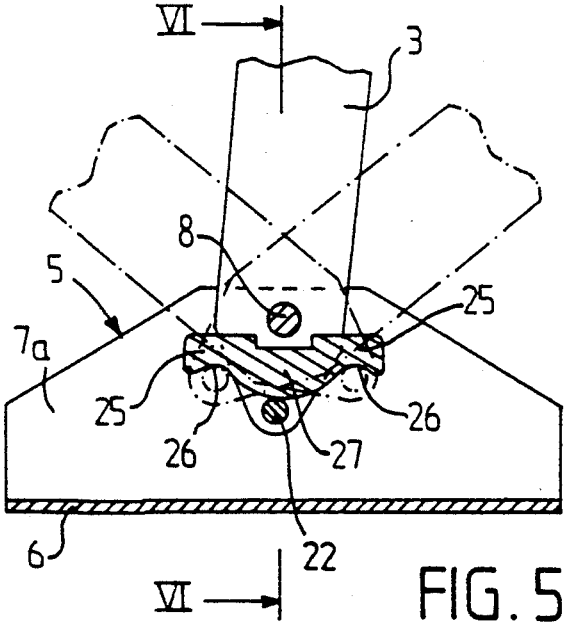
FIG. 5 is a cross-sectional view of the other housing provided with the bolt of the antipanic lock, showing three positions of the associated lever, one in continuous lines, the other two chain-dotted.
Figure 6:
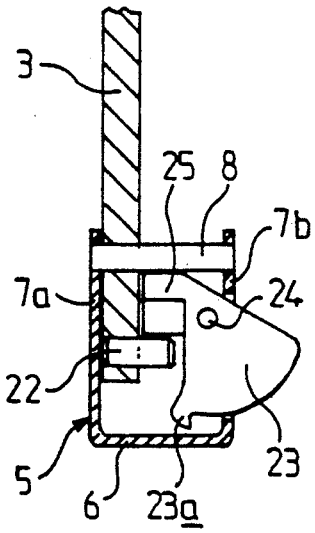
FIG. 6 is a cross-sectional view according to line VI—VI of FIG. 5.

To proceed to the reversing of the device shown in the FIGS. 1 to 6, one exerts, in a first step, onto the thrust member 14, a pressure in the direction of the length of the bottom 6 of the housing 4, in order to translatingly move this thrust member 14 on the bottom 6, to position the recess 16 under the end of the actuating lever 2, as shown in FIG. 3. Then, the angular spring-movement of the lever 2 is no longer limited by the protuberance 15*a* against which said lever 2 came to rest. Then, the lever 2 can be caused to pivot, since the cylindrical pawl 12 engages into the recess 16.

As soon as the pawl 12 (or cylindrical thrust) of the lever has engaged into the recess 16, the thrust 14 can be released, which is pulled off to its neutral median position by the spring or springs 18.

Then, it is enough to continue the started tilting of the lever 2, in order to cause it to pass to the second dihedron, to its neutral position. During this tilting, the pawl 12 of the lever will push back the thrust 14 by acting against the inner flank of the proturberance 15*b* and by causing the compression of the corresponding spring 18. As soon as the pawl 12 will have reached the top of the proturberance 15*b*, the springs 18 will pull off the thrust 14 to its neutral median position and the upper face of the proturberance 15*b* will slide under the pawl 12. The thrust 14 will again play its role, while the position of the lever 2 has been reversed.

The leg 11 of the spring which was initially resting against the thrust 12 of the lever 2 is now resting against the foot 13, the other one, which was the one resting against the foot 13, is now resting against the thrust 12. The spring 10 thus fulfills its pulling-off function for the two possible swing-movement areas of the lever 2.

Simultaneously, the lever 3 has pivoted about its spindle 8, the actuating pawl 22 describing an arc of a circle tangentially to the curved part 27 of the journal 25 of the bolt 23, so as to pass from one notch 26 to another one.

The antipanic lock is thus ready to be used on the door the opening direction of which did not correspond to the initial configuration of the lock.

In order to reverse the direction of operation of the lock shown in the FIGS. 7 and 8, the screw 155 is to be loosened in order to allow the pivoting of the member 150 about its spindle 153.

By slightly disengaging the lever 2 from the thrust 151, the thrust member 150 is caused to pivot by a quarter turn about the spindle 153. This new position of the thrust member 150 enables the angular spring-movement of the lever 2, whereby this lever 2 can pass right above the foot 152 and thus pass to the other dihedron.

Once this has been accomplished and the lever 102 brought to the second dihedron, the thrust member is again caused to pivot by a quarter turn in the same direction, so that the thrust 151 comes to be at the level of the end of the lever 102, symmetrically to its initial position with respect to the plane perpendicular to the bottom 106 passing through the spindle 153.

Once this has been accomplished, the screw 155 is tightened again, so as to clamp the thrust member 150 in its position.

In the same way as before, the rests of the legs 111 of the springs 110 have been interchanged, as well as the co-operation of the notches 26 with the actuating pawls 22. Thus tilted, this antipanic lock is ready to be fitted onto a door, thanks to the reversing of its direction of operation.

We claim:

1. An antipanic lock for a door comprising a first housing including a bolt mounted in said first housing and movable from a retracted position to allow opening a door to an extended position where said bolt extends exteriorly to said housing to engage a keeper to lock the door, said lock including a second housing with said housings being adapted to be mounted in spaced apart locations on a surface of a door, an actuating rod extending between said first and second housings and having end portions each connected to a respective first and second lever at one end thereof, each lever having an opposite end pivotally mounted in a respective housing, said first lever being a control lever which engages an operating member in said first housing so as to move said bolt when said control lever is moved from a neutral position to an actuated position corresponding to movement of said bolt from said extended, position to said retracted position, said second lever having torsion spring means including two, spaced spring legs, said second housing including a pivot means on which said second lever is pivotably mounted, said second lever having an end portion and a projecting part on said end portion for engaging a said spring leg corresponding to a selected door opening direction, said second lever being movable about said pivot means so that said projecting part engages the other of said spring legs corresponding to a door opening direction opposite to said selected direction, said second housing including abutment means for engaging the said spring leg that is unengaged by said projecting part.

2. The antipanic lock according to claim 1 where said second housing includes a side wall from which said pivot means extends and said abutment means is attached to said side wall adjacent said pivot means.

3. The antipanic lock according to claim 1 where said second housing includes a thrust member disposed to limit the movement of said second lever between a first, neutral position where said bolt is in said extended position and a second position where said bolt is in said retracted position for a selected door opening direction, said thrust member being movable in said second housing to allow said second lever to be moved so as to be engageable therewith and to limit the movement of said second lever between a second, neutral position where said bolt is in said extended position and another second position where said bolt is in said retracted position for a door opening direction that is in a direction opposite to said selected direction.

4. The antipanic lock according to claim 3 where said said thrust member includes a first and a second portion and said second lever engages said first portion to limit movement of said second lever between said first, neutral and second positions and engages said second portion of said thrust member to limit movement thereof between said second, neutral and another second positions.

5. The antipanic lock according to claim 3 or 4 where said second housing includes retaining means for retaining said thrust member in a selected position in said housing.

6. The antipanic lock according to claim 3 where said second housing includes a bottom wall on which said thrust member is disposed to be movable in translation.

7. The antipanic lock according to claim 4 where said first and second portions of said thrust member comprise spaced protuberances separated by a recess through which said end portion of said second lever can pivot.

8. The antipanic lock according to claim 7 where a rod extends from said side wall of said second housing into said recess of said thrust member.

9. The antipanic lock according to claim 5 where said retaining means includes a pair of spring means operating in opposite directions on said thrust member to retain said thrust member in a selected position.

10. The antipanic lock according to claim 3 where said second housing includes a bottom wall and said thrust member is movably attached to said bottom wall so as to be shiftable between two positions corresponding to a selected door opening direction.

11. The antipanic lock according to claim 10 where said bottom wall includes a shaft extending perpendicularly therefrom and about which shaft said thrust member is rotatable.

12. The antipanic lock according to claim 10 or 11 where a screw secures said thrust member to said bottom wall in a selected position.

13. The antipanic lock according to claim 12 where said bottom wall includes an arcuate slot receiving said screw.

14. The antipanic lock according to claim 1 where said bolt is pivotably mounted in said first housing so as to be movable between said extended and retracted positions, said bolt including an actuating pawl having two symmetrically spaced portions alternately engageable by said first lever where a screw secures said thrust member to said bottom wall in a selected position.

* * * * *